US009808824B2

(12) United States Patent
Vatanen et al.

(10) Patent No.: US 9,808,824 B2
(45) Date of Patent: Nov. 7, 2017

(54) ARRANGEMENT IN CONNECTION WITH CURTAIN COATING OF A FIBROUS WEB

(71) Applicants: Heikki Vatanen, Järvenpää (FI); Timo Nurmiainen, Järvenpää (FI)

(72) Inventors: Heikki Vatanen, Järvenpää (FI); Timo Nurmiainen, Järvenpää (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 68 days.

(21) Appl. No.: 14/850,635

(22) Filed: Sep. 10, 2015

(65) Prior Publication Data

US 2016/0074898 A1 Mar. 17, 2016

(30) Foreign Application Priority Data

Sep. 11, 2014 (FI) ..... 20144192

(51) Int. Cl.

| | |
|---|---|
| ***B05C 5/00*** | (2006.01) |
| ***B05C 3/00*** | (2006.01) |
| ***B05C 11/00*** | (2006.01) |
| ***B05C 11/10*** | (2006.01) |
| ***D21H 23/48*** | (2006.01) |

(52) U.S. Cl.

CPC ..... *B05C 5/005* (2013.01); *B05C 11/1039* (2013.01); *D21H 23/48* (2013.01)

(58) Field of Classification Search

USPC ..... 118/300, 326, 419, 411, 261, 262, 244, 118/429, 602, DIG. 4, 325, 323, 321, 402; 427/420

See application file for complete search history.

(56) References Cited

U.S. PATENT DOCUMENTS

| | | | | |
|---|---|---|---|---|
| 3,361,059 | A * | 1/1968 | Klinger | B41F 9/1036 100/174 |
| 5,017,408 | A | 5/1991 | Kozak | |
| 6,387,455 | B1 * | 5/2002 | Katagiri | B05C 5/008 118/324 |
| 7,669,549 | B2 * | 3/2010 | Ueberschar | B05D 1/305 118/262 |
| 7,694,646 | B2 | 4/2010 | Vatanen et al. | |

FOREIGN PATENT DOCUMENTS

| | | | |
|---|---|---|---|
| DE | 202012104934 | U1 | 3/2013 |
| EP | 1595601 | A2 | 11/2005 |

* cited by examiner

*Primary Examiner* — Yewebdar T Tadesse
(74) *Attorney, Agent, or Firm* — Stiennon & Stiennon

(57) ABSTRACT

An arrangement in a curtain coater for starting and stopping coating of a web, having a reservoir and a connected surface extending over the web toward the curtain to collect the coating as the coater moves over the web to start coating the web. A cover plate that swing around a cross-direction shaft connected to the cover plate. In one embodiment the shaft also moves in the machine direction. The cover plate is used to protect an leading edge of the collecting surface from being covered with coating and pivots to be cleaned with fluid which may be supply from the shaft. The cover plate is arranged so the fluid drain off the cover plate onto the collecting surface or reservoir. When clean, the cover plate is repositioned to protect an leading edge of the collecting surface during the next start or stop operation of coating the web.

18 Claims, 2 Drawing Sheets

ARRANGEMENT IN CONNECTION WITH CURTAIN COATING OF A FIBROUS WEB

CROSS REFERENCES TO RELATED APPLICATIONS

This application claims priority on Finnish Application No. FI 20144192, filed Sep. 11, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement in connection with the curtain coating of a fibrous web. The invention particularly relates to an arrangement in connection with curtain coating which comprises a movable nozzle beam for providing a coating material curtain for coating a fibrous web, means for moving the nozzle beam, a support member (s) of the fibrous web for guiding the fibrous web below the coating material curtain, a return reservoir and a collecting surface connected to it for at least collecting the coating material before and/or after the coating.

In this specification, coating refers to coating but also to the application of glue i.e., sizing agent, barrier material or equivalent.

Utility model specification DE20201210493U1 describes a device for receiving coating material of a fibrous web before the start of the coating process by a fibrous web coating device into a receiver of coating material, such as a return reservoir, which device includes a receiver part which receives coating material and a cleaning device arranged into connection with the receiver which is arranged with the coating device on the same side of the fibrous web.

As known of prior art, curtain coating most commonly utilizes two different ways to start the coating or a combination of these ways. One of the known ways implements the start of coating by moving a nozzle beam; the other one uses a movable plate under the curtain; and in the combination, at the start both the nozzle beam is moved and the movable plate is used. These known ways have their own special characteristics and problems particularly related to usability and start control.

Starting by moving the nozzle beam is a technically simple arrangement as such and, at the start, coating material, such as e.g. coating color, sizing agent, barrier material or equivalent, is collected into a return reservoir and onto a collecting surface fixedly connected to it, whereby the problem can be the cleansing of the edge of the collecting surface after the start, because coating material sticks to its tip. When a coating material curtain passes the tip of the collecting surface of the reservoir, it simultaneously dirties its tip also on the bottom side i.e. on the side of the fibrous web, whereby the dirtying becomes a cleansing problem. The tip of the collecting surface cannot be cleaned during run without the danger of disturbing the stability of the curtain, because an operator or some other person doing the cleaning causes air flows in the vicinity of the curtain when cleaning, which air flows make the curtain to oscillate and thus the stability of the curtain is disturbed. Furthermore, a cleaning operation done during run is problematic for work safety, because the person doing the cleaning gets close to moving parts and the moving fibrous web. It is known that the maximum moving speed of the nozzle beam is about 100 mm/s in order to keep the stability of the curtain. It is still typical to use lower speeds, e.g. 50 mm/s.

Starting by means of a movable plate is a solution as such for keeping the tip clean but, to work, it requires a relatively quick movement, typically over 300 mm/s, in order for the coating curtain not to follow the start plate in an undesired amount, which causes harmful air flows in the area of the curtain and the stability of the curtain is disturbed.

It should be noted that, in order for the curtain coating to be successful, the stability of the curtain is of utmost importance.

One has also tried to solve the cleansing problem by moving/turning the return reservoir into a cleaning position after the start of coating but, typically, this cannot be implemented due to limited space available on the curtain coater and, on the other hand, the moving/turning of a large subassembly generates harmful air flows, whereby the stability of the curtain is disturbed.

SUMMARY OF THE INVENTION

The object of the invention is to provide an arrangement by means of which the above problems known of prior art can be eliminated or at least minimized.

An object of the invention is to introduce an arrangement which solves the usability problems of coating start arrangements known of prior art, particularly those related to the stability of the curtain.

An additional object of the invention is to provide an arrangement in which the problems related to the cleansing of the tip of the collecting surface of the return reservoir have been solved.

To achieve the above objects and those that come out later, the arrangement according to the invention is mainly a cover plate which has at least two positions: a front position and a cleaning position, that the cover plate is arranged turnable by a swinging motion around a pivoted shaft connected to the cover plate, the shaft extending in the cross-direction of the fibrous web and pivoting from a cleaning position to a front position and back to the cleaning position. The cover plate in its front position is located to cover at least a tip of a collecting surface of a return reservoir, and that the cover plate is in its cleaning position located to extend above the collecting surface of the return reservoir such that possible cleaning liquids for the cover plate are conveyed to the return reservoir.

The arrangement according to the invention comprises a turnable cover plate which is provided with a pivoted shaft to turn the cover plate in the cross-direction of the fibrous web, that is, around its pivoted shaft extending in a cross-wise direction in relation to the main travel direction of the fibrous web from a front position to a cleaning position. At the start of coating i.e. in the front position, the cover plate covers the tip of the return reservoir and, after the start of coating, the cover plate is turnable around its pivoted shaft into the cleaning position for cleaning/washing the cover plate. In the cleaning position, the cover plate is located above the return reservoir and at a substantial distance from the coating material curtain, whereby the stability of the curtain will not be disturbed. In the arrangement according to the invention, the start of coating is implemented in a known way as such by moving the nozzle beam, whereby the nozzle beam is moved by a linear motion which does not endanger the stability of the curtain. When the cover plate has been washed, it is turnable back to its front position to protect the tip of the return reservoir from dirtying caused by the end of coating. The cover plate simultaneously operates in this front position i.e. start position i.e. run position i.e. end position as a control plate of air flows passing in the vicinity of the curtain and thus enhances the keeping of the stability of the curtain.

According to an advantageous additional characteristic of the invention, the speed of the turning motion of the cover plate is slow at least in the initial step of the turning motion, most advantageously at the start of the turning motion the time used for a 90-degree turn is at least 10 seconds, advantageously more than 15 seconds.

According to an advantageous further characteristic of the invention, the distance of the end of the cover plate on the curtain side from the curtain is 20-150 mm, more advantageously 50-100 mm.

In the arrangement according to the invention, the cover plate is in its front position covering the tip of the return reservoir at least at the start of coating and the end of coating.

According to an advantageous embodiment of the invention, the cover plate is transferable by a linear motion from the front position into a back position being away from the curtain, out of which, it is turnable around its pivoted shaft into the cleaning position. Hence in this embodiment, the tip of the collecting surface of the return reservoir is covered by the movable cover plate which, at the start of coating, covers the tip of the return reservoir. The start of coating is implemented in a known way as such by moving the nozzle beam, whereby the nozzle beam is moved by a horizontal motion. When the start has occurred and the nozzle beam has been moved into its operating position i.e. coating position, the cover plate is transferred to the back position by a slow motion i.e. a linear motion away from the coating material curtain, whereby no harmful air flows are generated in the coating material curtain and the stability of the curtain remains. In the back position, the cover plate is turnable into the cleaning position and thus the cover plate is washable. When the cover plate has been washed, it is controllable back to its front position to protect the tip of the return reservoir from dirtying caused by the end of coating and to stabilize harmful air flows.

According to an advantageous additional characteristic of the invention, the speed of the linear motion of the cover plate is at its maximum 50 mm/s, advantageously at its maximum 25 mm/s.

In an advantageous embodiment of the invention, the initial step of the turning motion and the possible linear motion are implemented as slow, whereby changes in pressure balance and air flows are slow and the stability of the curtain will not be disturbed.

According to an advantageous further characteristic of the invention, the pivoted shaft of the cover plate is formed as a cleaning shaft, whereby it is possible to convey cleaning liquid via it onto the cover plate in the cleaning position.

The invention is applicable when using different types of nozzle beams of curtain coating known as such, such as when using a slide nozzle beam or a slot nozzle beam.

According to an advantageous additional characteristic, the linear motion of the cover plate occurs simultaneously with the motion of the nozzle beam.

In an arrangement according to the invention, the cleaning is implemented far from moving parts and the curtain, whereby work safety issues can be controlled. Furthermore if needed, the arrangement can be provided with a cleaning device, whereby no manual cleaning measures are required.

Next, the invention will be described in more detail with reference to the figures of the enclosed drawing, to which the invention is by no means intended to be limited in any way.

DESCRIPTION OF THE PREFERRED EMBODIMENTS

Figure 1:
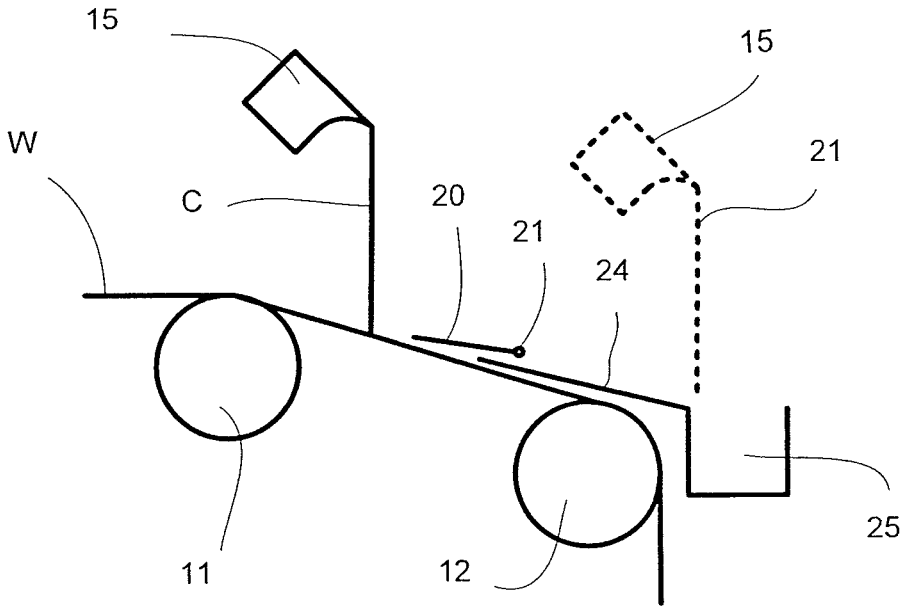
FIG. 1 schematically shows an example of an arrangement according to the invention at the start of coating when using a slide nozzle beam as a curtain coater.

FIGS. 1-4 and the following description employ the same designations of parts and subassemblies corresponding each other, if not otherwise stated.

In FIGS. 1-4, a fibrous web W to be curtain-coated is guided via a support member/support members of the fibrous web W, which in the examples of the figures consist of two rolls 11, 12, to curtain coating by a coating material curtain C via the roll 11 and then, after the coating, to further processing via the roll 12. Close to the roll 12 after the coating, after the roll 12, is located a return reservoir 25, a collecting plate 24 connected to which substantially extends above the fibrous web W in the main travel direction of the fibrous web W such that a tip of the collecting surface 24 of the return reservoir 25 is at a substantial distance from the curtain C. The distance between the fibrous web W and the collecting surface 24/cover plate 20 is advantageously 5-25 mm. The coating material curtain C is formed by a nozzle beam 15 which is a slide nozzle beam 15 in the examples of FIGS. 1-3 and a slot nozzle beam 15 in the example of FIG. 4. The arrangement comprises a mechanism, e.g., a rail and piston, drive motor or linkage, for moving the nozzle beam 15. Coating material can be e.g. coating color, sizing agent, barrier material or other equivalent coating material which is applied on the fibrous web W.

The examples shown in FIGS. 1-4 are simplified end views. It should be understood that the shown parts and subassemblies extend in the cross-direction of the fibrous web W, i.e. in the crosswise direction of the main travel direction of the fibrous web W substantially over the cross-direction of the fibrous web W at a desired distance.

As shown in FIG. 1 at the start of coating, the nozzle beam 15 is transferred from its position above the return reservoir 25, which is shown by a dashed line, into the coating position, which is shown by a uniform line, in which coating position, the coating material curtain C meets the fibrous web W as a curtain directed from above substantially extending in the cross-direction of the web. Equivalently at the end of coating, the nozzle beam is transferred from the coating position to the position being above the return reservoir.

Figure 2:
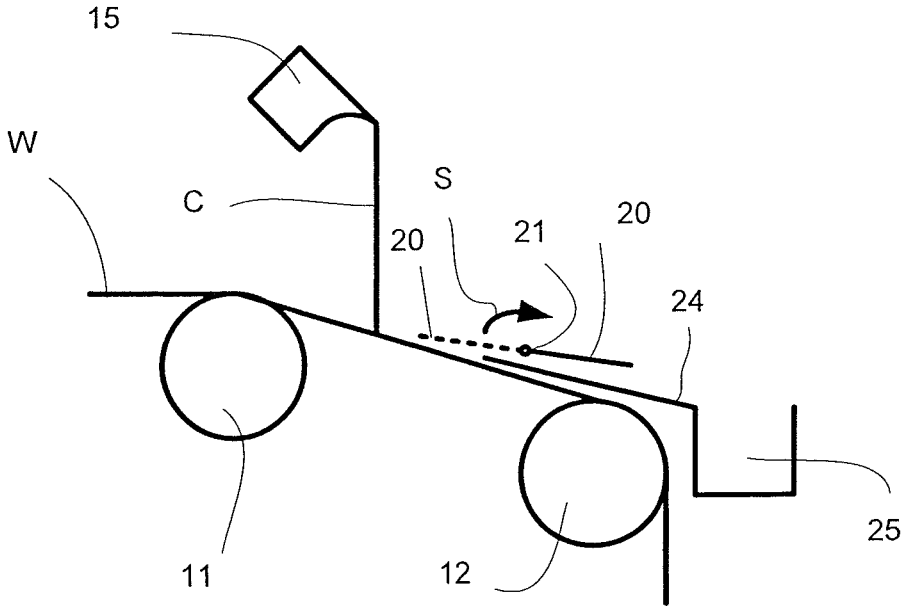
FIG. 2 schematically shows an example according to FIG. 1 in the cleaning step of a cover plate.

As shown in FIGS. 1-4, the arrangement comprises a turnable cover plate 20 which is provided with a pivoted shaft 21 to turn the cover plate in fibrous web W around its pivoted shaft 21 extending in the crosswise direction in relation to a fibrous web W from a front position to a cleaning position. The turning motion of the cover plate 20 from the front position to the cleaning position is shown by a swinging direction arrow S in FIGS. 2 and 3. FIG. 2 shows the front position of the cover plate 20 by dashed lines and its cleaning position by uniform lines. The return swinging motion from the cleaning position to the front position is naturally opposite to that of the swinging direction arrow S. In the front position, the cover plate 20 is located such that it covers above at least the tip of the collecting surface 24 of the return reservoir 25. The cover plate 20 is in its front position at least at the start of coating and the end of coating, advantageously also during coating except for the washing of the cover plate 20 after the start, whereby the cover plate 20 is in the cleaning position. In the front position, FIGS. 1 and 4, the cover plate 20 thus covers the tip of the collecting surface 24 of the return reservoir 25. After the start of coating, the cover plate 20 is turnable around its pivoted shaft 21 into the cleaning position for cleaning/washing the cover plate 20. In the cleaning position, FIGS. 2 and 3, the cover plate 20 is located above the return reservoir 25, particularly the collecting surface 24 of the return reservoir 25, such that cleaning liquids are conveyable to the return reservoir 25. When the cover plate 20 has been washed, it is turnable back to its front position to protect the tip of the collecting surface 24 of the return reservoir 25 from dirtying caused by the end of coating. During coating, the cover plate 20 operates in this front position also as a guide plate of air flows passing in the vicinity of the curtain C.

Figure 3:
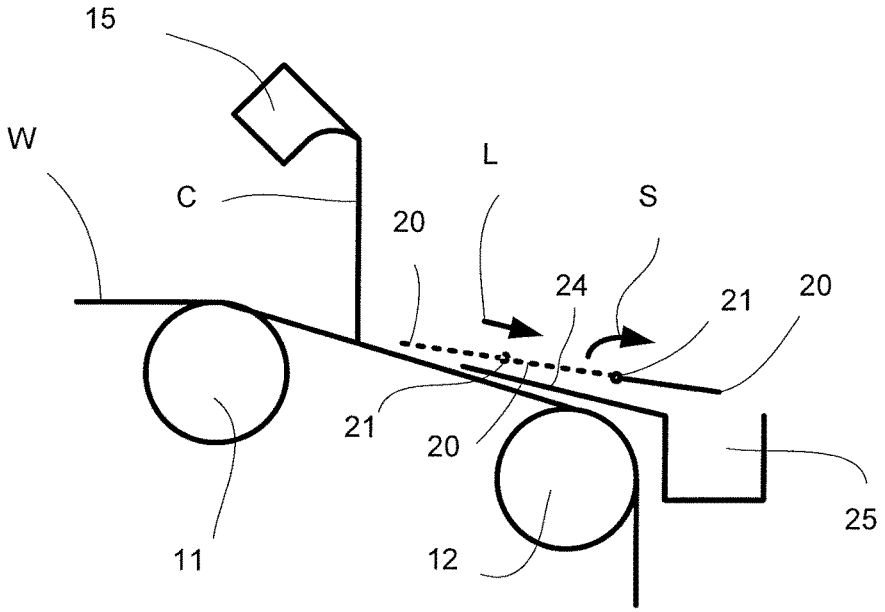
FIG. 3 schematically shows another example of an arrangement according to the invention in the cleaning step of the cover plate when using the slide nozzle beam as a curtain coater.
Figure 4:
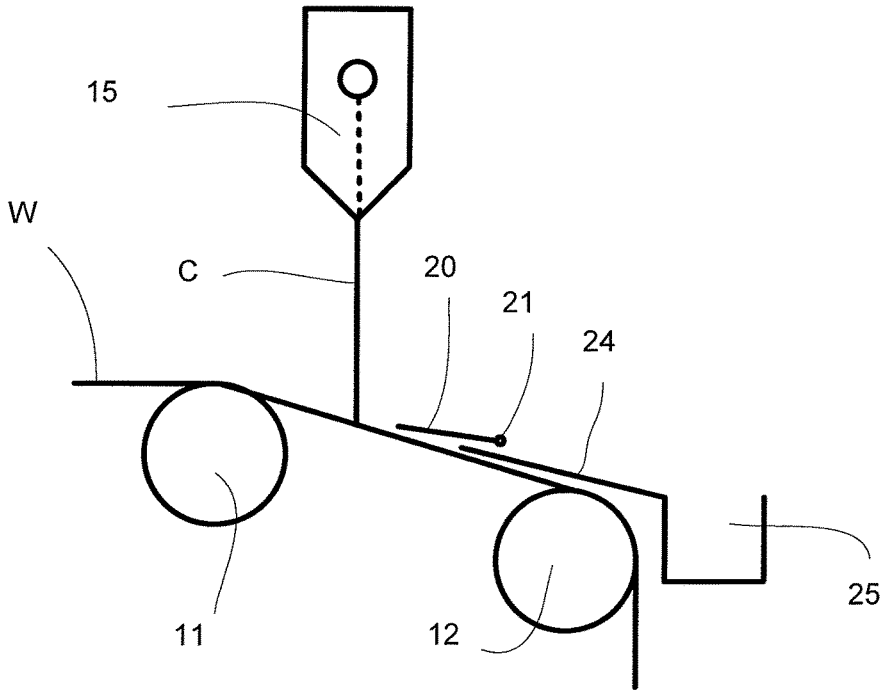
FIG. 4 schematically shows an example according to FIG. 1 of an arrangement according to the invention at the start of coating when using a slot nozzle beam as a curtain coater.

In the example of FIG. 3, the cover plate 20 is transferable by the swinging motion S but also by a linear motion L from the front position, which is designated with dashed lines on the side of the curtain C, into a back position being away from the curtain C, which is designated with dashed lines on the side of the return reservoir. From the back position, the cover plate 20 is turnable around its pivoted shaft 21 into the cleaning position, which is designated with uniform lines. In this embodiment, when the start of coating has occurred and the nozzle beam 15 has been transferred to its operating position i.e. coating position, the cover plate 20 is transferred to the back position by the linear motion away from the coating material curtain C and, from the back position, the cover plate 20 is turnable to the cleaning position and thus the cover plate 20 is washable. When the cover plate 20 has been washed, it is guidable back into its front position to protect the tip of the collecting surface 24 of the return reservoir 25 from dirtying caused by the end of coating and to guide air flows in the vicinity of the curtain C.

The arrangement can comprise a mechanism, e.g., a motor or piston, for providing the swinging motion S of the cover plate 20 around the pivoted shaft 21 and, in the example according to FIG. 3, a mechanism for implementing the linear motion of the cover plate 20. The swinging motion S and the linear motion L can also be implemented for manual performance.

The pivoted shaft 21 of the cover plate 20 is advantageously formed as a cleaning shaft with opening(s) from which cleaning liquids are conveyed onto the cover plate 20 for its cleaning.

The invention was described above referring to its advantageous embodiments to the details of which the invention is not intended to be narrowly limited but many modifications and variations are possible within the inventive idea.

We claim:

1. A curtain coater, comprising:

a movable nozzle beam forming a coating material curtain for coating a fibrous web;

a return reservoir forming an upwardly opening reservoir, and a collecting surface which drains into the upwardly opening reservoir so as to receive coating material and cleaning fluid from above, the collecting surface extending to a tip in a direction which extends over the web toward the nozzle beam when the nozzle beam is positioned for coating the fibrous web, the collecting surface arranged to collect the coating material at least before or after the coating of the fibrous web;

a source of cleaning fluid positioned above the return reservoir;

a mechanism for moving the nozzle beam from a position over the return reservoir and the collecting surface to a position over the web for coating the web;

at least one support member for guiding the fibrous web below the coating material curtain when the nozzle beam is in the position over the web;

a cover plate movably mounted to swing around a pivoted shaft connected to the cover plate, the pivoted shaft extending in a cross-direction with respect to a direction of travel of the fibrous web;

wherein the cover plate is movable between at least two positions, a front position where the cover plate extends beyond the collecting surface tip and toward the coating material curtain positioned for coating the fibrous web and a cleaning position where the cover plate is located to extend above the collecting surface of the return reservoir and positioned with respect to the source of cleaning fluid such that cleaning fluids applied to the cover plate are conveyed to the return reservoir; and wherein the cover plate is mounted for movement between the cleaning position and the front position.

2. The curtain coater of claim 1 wherein when the cover plate is located in the front position the coating material curtain is spaced a distance of 20-150 mm from the cover plate.

3. The curtain coater of claim 2 wherein when the cover plate is located in the front position the coating material curtain is spaced a distance of 50-100 mm from the cover plate.

4. The curtain coater of claim 1 wherein the cover plate is mounted for movement between the cleaning position and the front position by a swinging motion, and wherein the cover plate is connected to be driven by a speed limiting mechanism from the front position to the cleaning position;

wherein the speed limiting mechanism is arranged to have a speed which takes at least 10 seconds for a 90-degree swing.

5. The curtain coater of claim 4 wherein the speed limiting mechanism is arranged to have a speed which takes more than 15 seconds for a 90-degree swing.

6. The curtain coater of claim 1 wherein the cover plate has at least three positions, the front position, a back position and the cleaning position, and that the pivoted shaft and the swingably mounted cover plate are mounted for movement in a linear direction from the front position to the back position and away from the coating material curtain and, when in the back position, the cover plate is mounted to swing about the pivoted shaft into the cleaning position.

7. The curtain coater of claim 6 wherein the cover plate is connected to be driven by a speed limiting drive mechanism controlling the linear motion of the cover plate from the front position to back position;

wherein the speed limiting mechanism is arranged to have a speed of no more than 55 mm/s.

8. The curtain coater of claim 1 wherein the cover plate in the front position forms a guide plate for air flows passing in the vicinity of the coating material curtain.

9. The curtain coater of claim 1 wherein the pivoted shaft is connected to the source of cleaning fluid so that the cleaning fluid is conveyed via the pivoted shaft to clean the cover plate.

10. An arrangement for use in connection with curtain coating, having a movable nozzle beam forming a coating material curtain, the beam mounted for movement from a first position not over a moving supported fibrous web to a second position over the moving supported fibrous web, for coating a fibrous web, comprising:

a return reservoir forming an upwardly opening reservoir, and a collecting surface connected thereto which drains into the upwardly opening reservoir so as to receive coating material and cleaning fluid from above, the collecting surface extending in a first direction over the web toward the coating material curtain when the nozzle beam is positioned for coating the fibrous web in the second position, the collecting surface arranged to collect the coating material as the beam is moved from the first position to the second position;

a source of cleaning fluid positioned above the return reservoir;

a cover plate movably mounted to swing around a pivoted shaft connected to the cover plate, the pivoted shaft extending in a cross-direction with respect to a direction in which the fibrous web travels;

wherein the cover plate is mounted for movement between at least two positions, a front position where the cover plate extends beyond the collecting surface in the first direction and a cleaning position where the cover plate extends above the return reservoir such that cleaning liquid applied to the cover plate from the source of cleaning fluid will be conveyed to the return reservoir; and wherein the cover plate is mounted for movement between the cleaning position and the front position.

11. The arrangement of claim 10 wherein when the cover plate is located in the front position the coating material curtain is spaced a distance of 20-150 mm from the cover plate.

12. The arrangement of claim 10 wherein when the cover plate is located in the front position the coating material curtain is spaced a distance of 50-100 mm from the cover plate.

13. The arrangement of claim 10 wherein the swinging motion of the cover plate is connected to be driven by a speed limiting mechanism from the front position to the cleaning position; and wherein the speed limiting mechanism is arranged to have a speed which takes more than 10 seconds for a 90-degree swing.

14. The arrangement of claim 10 wherein the pivoted shaft is connected to a supply of cleaning fluid and the pivoted shaft comprises a source of cleaning fluid to clean the cover plate.

15. An arrangement for use in connection with curtain coating, having a movable nozzle beam forming a coating material curtain, the beam mounted for movement from a first position not over a moving supported fibrous web to a second position over the moving supported fibrous web, for coating a fibrous web, comprising:

a return reservoir forming an upwardly opening reservoir, and a collecting surface connected thereto which drains into the upwardly opening reservoir so as to receive coating material and cleaning fluid from above, the collecting surface extending in a first direction over the web toward the coating material curtain when the nozzle beam is positioned for coating the fibrous web in the second position, the collecting surface arranged to collect the coating material as the beam is moved from the first position to the second position;

a source of cleaning fluid positioned above the return reservoir;

a cover plate movably mounted to swing around a pivot shaft connected to the cover plate, the pivot shaft extending in a cross-direction with respect to a direction in which the fibrous web travels;

wherein the cover plate and the pivot shaft are mounted for linear movement to move in a second direction opposite the first direction;

wherein the cover plate is movable in the second direction between a front position where the cover plate extends over and beyond the collecting surface in the first direction, and a back position where the cover plate does not extend beyond the collecting surface in the first direction, and in the back position the cover plate is swingable around the pivot shaft to a cleaning position in which the cover plate extends above the return reservoir such that cleaning liquids applied to the cover plate from the source of cleaning fluid will be conveyed to the return reservoir; and wherein the cover plate is mounted for movement between the cleaning position and the front position.

16. The curtain coater of claim 15 wherein the cover plate is connected to be driven by a speed limiting drive mechanism controlling the linear motion of the cover plate from the front position to back position;

wherein the speed limiting mechanism is arranged to have a speed of no more than 55 mm/s.

17. The arrangement of claim 16 wherein the pivoted shaft is connected to a supply of cleaning fluid and the pivoted shaft comprises a source of cleaning fluid to clean the cover plate.

18. The arrangement of claim 15 wherein the cover plate in the front position is a guide plate of air flows passing in the vicinity of the coating material curtain.

* * * * *